US010843271B2

(12) United States Patent
Mottin et al.

(10) Patent No.: US 10,843,271 B2
(45) Date of Patent: Nov. 24, 2020

(54) METHOD FOR MANUFACTURING A TURBINE SHROUD FOR A TURBOMACHINE

(71) Applicants: SAFRAN AIRCRAFT ENGINES, Paris (FR); CENTRE NATIONAL DE LA RECHERCHE SCIENTIFIQUE, Paris (FR); UNIVERSITE PAUL SABATIER—TOULOUSE III, Toulouse (FR)

(72) Inventors: Jean-Baptiste Mottin, Moissy-Cramayel (FR); Yannick Marcel Beynet, Toulouse (FR); Geoffroy Chevallier, Auzeville-Tolosane (FR); Romain Epherre, Toulouse (FR); Claude Estournes, Rieumes (FR)

(73) Assignees: SAFRAN AIRCRAFT ENGINES, Paris (FR); CENTRE NATIONAL DE LA RECHERCHE SCIENTIFIQUE, Paris (FR); UNIVERSITE PAUL SABATIER—TOULOUSE III, Toulouse (FR)

( * ) Notice: Subject to any disclaimer, the term of this patent is extended or adjusted under 35 U.S.C. 154(b) by 160 days.

(21) Appl. No.: 16/084,567

(22) PCT Filed: Mar. 10, 2017

(86) PCT No.: PCT/FR2017/050546
§ 371 (c)(1),
(2) Date: Sep. 13, 2018

(87) PCT Pub. No.: WO2017/158264
PCT Pub. Date: Sep. 21, 2017

(65) Prior Publication Data

US 2019/0054537 A1 Feb. 21, 2019

(30) Foreign Application Priority Data

Mar. 14, 2016 (FR) ..... 16 52102

(51) Int. Cl.
*B22F 5/00* (2006.01)
*B22F 3/105* (2006.01)
(Continued)

(52) U.S. Cl.
CPC ..... *B22F 5/009* (2013.01); *B22F 3/105* (2013.01); *B22F 3/24* (2013.01); *B22F 7/06* (2013.01);
(Continued)

(58) Field of Classification Search
CPC .... B22F 5/009; B22F 7/06; B22F 3/24; B22F 3/105; B22F 7/08; B22F 2207/01;
(Continued)

(56) References Cited

U.S. PATENT DOCUMENTS

2004/0261978 A1* 12/2004 Zhan ..... C04B 35/46 165/104.11
2012/0107103 A1* 5/2012 Kojima ..... F01D 11/122 415/173.4
(Continued)

FOREIGN PATENT DOCUMENTS

EP 2 159 460 A1 3/2010
FR 2 941 965 A1 8/2010

OTHER PUBLICATIONS

International Search Report dated May 10, 2017, in International Application No. PCT/FR2017/050546 (9 pages).
(Continued)

*Primary Examiner* — Rick K Chang
(74) *Attorney, Agent, or Firm* — Bookoff McAndrews, PLLC

(57) ABSTRACT

The invention relates to a method for manufacturing a turbine shroud (24) for a turbomachine, the method comprising manufacturing at least one turbine shroud sector (28), positioning the turbine shroud sector (26) in a bottom mold so that an outer surface of the turbine shroud sector is in contact at least in part with the bottom mold, and depositing a powder layer on an inner surface (28) of the turbine shroud sector (26). Thereafter, a top mold is positioned on the powder layer and an abradable layer (32) is made by subjecting the powder layer to a method of SPS sintering, the abradable layer (32) being for being disposed facing a turbine wheel.

9 Claims, 3 Drawing Sheets

(51) Int. Cl.

| | |
|---|---|
| ***B22F 7/08*** | (2006.01) |
| ***B22F 7/06*** | (2006.01) |
| ***B22F 3/24*** | (2006.01) |
| ***F01D 9/04*** | (2006.01) |
| *F01D 11/12* | (2006.01) |

(52) U.S. Cl.
CPC ..... *B22F 7/08* (2013.01); *F01D 9/04* (2013.01); *B22F 2003/247* (2013.01); *B22F 2207/01* (2013.01); *B22F 2301/15* (2013.01); *F01D 11/122* (2013.01); *F05D 2230/22* (2013.01); *F05D 2230/61* (2013.01); *F05D 2240/11* (2013.01)

(58) Field of Classification Search
CPC .. B22F 2301/15; B22F 2003/247; F01D 9/04; F01D 11/122; F05D 2230/22; F05D 2240/11; F05D 2230/61
See application file for complete search history.

(56) References Cited

U.S. PATENT DOCUMENTS

| | | | | |
|---|---|---|---|---|
| 2013/0017072 | A1 | 1/2013 | Ali et al. | |
| 2013/0052442 | A1* | 2/2013 | Merrill | B32B 15/16 428/220 |
| 2013/0086847 | A1* | 4/2013 | DiGiovanni | B01J 3/062 51/307 |
| 2013/0177740 | A1 | 7/2013 | Merrill et al. | |
| 2014/0263579 | A1* | 9/2014 | Kulkarni | B23K 1/0018 228/119 |
| 2017/0009329 | A1* | 1/2017 | Hunt | C23C 24/103 |

OTHER PUBLICATIONS

Monceau et al., "Thermal Barrier Systems and Multi-Layered Coatings Fabricated by Spark Plasma Sintering for the Protection of Ni-Base Superalloys," Materials Science Forum, Trans Tech Publications Ltd, vol. 654-656, Jan. 1, 2010, pp. 1826-1831.

Ratel et al., "Reactivity and microstructure evolution of a CoNiCrAlY/Talc cermet prepared by Spark Plasma Sintering," Surface Coatings Technology, Elsevier BV, vol. 205, No. 5, Nov. 25, 2010, pp. 1183-1188.

Monceau et al., "Pt-modified Ni aluminides, MCrAlY-base multilayer coatings and TBC systems fabricated by Spark Plasma Sintering for the protection of Ni-base superalloys," Surface and Coatings Technology, vol. 204, No. 6-7, Dec. 1, 2009, pp. 771-778.

* cited by examiner

METHOD FOR MANUFACTURING A TURBINE SHROUD FOR A TURBOMACHINE

CROSS-REFERENCE TO RELATED APPLICATIONS

This application is the U.S. national phase entry under 35 U.S.C. § 371 of International Application No. PCT/FR2017/050546, filed Mar. 10, 2017, which claims priority to French Patent Application No. 1652102, filed Mar. 14, 2016, the entireties of each of which are herein incorporated by reference.

BACKGROUND OF THE INVENTION

The present disclosure relates to a method for manufacturing a turbine shroud for a turbomachine.

In numerous rotary machines, it is now known to provide the ring of the stator with abradable tracks facing the tips of the blades of the rotor. Such tracks are made using so-called "abradable" materials, which, when they come into contact with rotating blades, become worn more easily than the blades themselves. This serves to ensure minimum clearance between the rotor and the stator, thereby improving the performance of the rotary machine, without running the risk of damaging the blades in the event of them rubbing against the stator. On the contrary, such rubbing erodes the abradable track, thereby acting automatically to match the diameter of the shroud of the stator as closely as possible to the rotor. Thus, such abradable tracks are often installed in turbomachine compressors.

In contrast, use of such tracks is less common in the turbines of such turbomachines, and in particular in the high pressure turbines in which physico-chemical conditions are extreme.

Specifically, the burnt gas coming from the combustion chamber flows into the high-pressure turbine at very high levels of temperature and pressure, thereby leading to premature wear of conventional abradable tracks.

Under such circumstances, in order to protect the turbine shroud, it is often preferred to provide it with a thermal barrier type coating made of materials that serve to protect the shroud against erosion and corrosion and that present density that is high, too high for the coating to be effectively abradable.

Nevertheless, under such circumstances, it can naturally be understood that the integrity of the blades is no longer ensured in the event of coming into contact with the stator, which makes it necessary to provide greater clearance between the rotor and the stator, and therefore increases the rate of leakage past the tips of the blades, thus reducing the performance of the turbine.

OBJECT AND SUMMARY OF THE INVENTION

The present disclosure seeks to remedy these drawbacks, at least in part.

To this end, the present disclosure relates to a method manufacturing a turbine shroud for a turbomachine, the method comprising the following steps:

manufacturing at least one turbine shroud sector;

positioning the turbine shroud sector in a bottom mold so that an outer surface of the turbine shroud sector is in contact at least in part with the bottom mold;

depositing a powder layer on an inner surface of the turbine shroud sector;

positioning a top mold on the powder layer; and making an abradable layer on the inner surface by subjecting the powder layer to a method of SPS sintering, the abradable layer being for being disposed facing a turbine wheel.

The turbine shroud is generally made out of a plurality of portions, each portion forming a turbine shroud sector of dimensions that are small compared with the dimensions of the complete turbine shroud. It is thus simple to place a shroud sector in a mold.

The inner surface of the turbine shroud sector is the surface that faces the turbine wheel when the turbine shroud is mounted in the turbine, and it is thus this inner surface on which the powder layer is deposited.

The SPS sintering method (SPS standing for "spark plasma sintering") is also known as field assisted sintering technology (FAST), or as flash sintering, and it is a method of sintering during which a powder is subjected simultaneously to high-current pulses and to uniaxial pressure in order to form a sintered material. SPS sintering is generally performed under a controlled atmosphere, and it may be assisted by heat treatment.

The duration of SPS sintering is relatively short, and SPS sintering makes it possible to select starting powders with relatively few limitations. Specifically, SPS sintering makes it possible in particular to sinter, i.e. to densify, materials that are relatively complicated to weld, or indeed impossible to weld, because they are materials that crack easily when heated. As a result of selecting SPS sintering and of the short duration of such sintering, it becomes possible to make an abradable layer out of a very wide variety of materials.

Furthermore, since SPS sintering is performed under uniaxial pressure exerted on the powder layer by the bottom mold and the top mold, the shrinkage of the powder layer that results from the sintering for producing the abradable layer is restricted to the direction in which pressure is applied. No shrinkage of the powder layer is thus to be observed in directions perpendicular to the direction in which pressure is applied. The abradable layer thus covers the entire inner surface of the shroud sector.

The turbine shroud is thus covered in an abradable layer. It is thus possible to make provision for the clearance between the turbine shroud and the rotor, e.g. the blades of a turbine wheel, to be relatively small, and to improve the performance of the turbine, but without any risk of damaging the blades in the event of them rubbing against the shroud of the stator.

Furthermore, SPS sintering enables a diffusion layer to be formed between the abradable layer and the material forming the shroud sector, such that the abradable layer is firmly attached to the material forming the shroud sector. The abradable layer as formed in this way cannot be removed from the shroud sector in unintentional manner.

The method may further comprise the following steps assembling together a plurality of turbine shroud sectors, the inner surface of each turbine shroud sector being covered in an abradable layer; and machining a free surface of the abradable layer.

Once a plurality of these turbine shroud sectors have been assembled together, the abradable layer of each shroud sector presents a free surface that need not necessarily extend continuously from the free surface of the adjacent shroud sector. Thus, the free surfaces of the various shroud sectors are machined so that the surface that is to face the turbine wheel presents as little discontinuity as possible. Specifically, if any such discontinuity is present, then the turbine wheel could strike against such a discontinuity, thereby leading to impacts within the turbine, which is not desirable.

The bottom mold may be of shape complementary to the outer surface of the turbine shroud sector.

Thus, the bottom mold applies relatively uniform pressure against the outer surface of the shroud sector. Nevertheless, since the bottom mold presents a shape that is complementary to the outer surface of the shroud sector, the mold makes it possible to accommodate variations in dimensions from one shroud sector to another due to the method for manufacturing a shroud sector. Specifically, and by way of example, the turbine sectors may be obtained by a casting method and the dimensions of each turbine sector may vary a little from one turbine sector to another.

Before positioning the turbine shroud sector in the bottom mold and the top mold, a layer of chemically inert material may be deposited on the bottom mold and on the top mold.

This layer of chemically inert material makes it possible to reduce chemical reactions between the powder layer and the turbine shroud sector with the bottom mold and the top mold during SPS sintering. The chemically inert material serves in particular to reduce, or even to avoid, the layer of abradable material and/or the shroud sector sticking to portions of the mold.

The chemically inert material also makes it possible to reduce, or even to avoid, any formation of a carbide layer on the free surface of the abradable layer. It is desirable to avoid forming such a carbide layer, since any carbide layer that is formed needs to be removed from the abradable layer before it is used.

In the bottom mold, the chemically inert material may also serve to fill in the gaps that exist between the bottom mold and the outer surface of the turbine shroud sector. This improves the uniformity of the pressure exerted by the bottom mold on the turbine shroud sector and thus on the powder layer.

By way of example, the chemically inert material may comprise boron nitride or corundum. When the chemically inert material is said to "comprise" boron nitride, that is used to mean that the material comprises at least 95% by weight boron nitride. Likewise, when the chemically inert material is said to "comprise" corundum, that is used to mean that the material comprises at least 95% by weight corundum.

The powder may be a metal powder based on cobalt or on nickel.

The term "based on cobalt" is used to mean a metal powder in which cobalt presents the greatest percentage by weight. Likewise, the term "based on nickel" is used to mean a metal powder in which nickel presents the greatest percentage by weight. Thus, by way of example, a metal powder comprising 38% by weight cobalt and 32% by weight nickel is referred to as a cobalt based powder, since cobalt is the chemical element having the greatest percentage by weight in the metal powder.

Cobalt- or nickel-based metal powders are powders that present good high-temperature strength after sintering. They can thus perform the two functions of being abradable and of providing a heat shield. By way of example, mention may be made of CoNiCrAlY superalloys. These metal powders also have the advantage of presenting a chemical composition that is similar to the chemical composition of the material forming the turbine shroud, e.g. AM1 or N5 superalloy.

The SPS sintering may be performed for a duration that is shorter than or equal to 60 minutes, preferably shorter than or equal to 30 minutes, still more preferably shorter than or equal to 15 minutes.

The duration of SPS sintering is thus relatively short.

The top mold and the bottom mold may be made of graphite, and the SPS sintering may be performed at a temperature higher than or equal to 800° C., preferably higher than or equal to 900° C.

The SPS sintering may be performed at a pressure higher than or equal to 10 megapascals (MPa), preferably higher than or equal to 20 MPa, still more preferably higher than or equal to 30 MPa.

The top mold and the bottom mold may be made of tungsten carbide, and the SPS sintering may be performed at a temperature higher than or equal to 500° C., preferably higher than or equal to 600° C.

The SPS sintering may be performed at a pressure higher than or equal to 100 MPa, preferably higher than or equal to 200 MPa, still more preferably higher than or equal to 300 MPa.

The abradable layer may have apparent porosity that is less than or equal to 20%, preferably less than or equal to 15%, still more preferably less than or equal to 10%.

By using the SPS sintering method, it is possible to vary sintering parameters such as pressure, sintering temperature, and/or sintering time, so as to vary the porosity of the resulting abradable layer. This method for manufacturing a turbine shroud for a turbomachine thus provides great flexibility.

The abradable layer may present thickness that is greater than or equal to 0.5 millimeters (mm), preferably greater than or equal to 4 mm, and less than or equal to 15 mm, preferably less than or equal to 10 mm, still more preferably less than or equal to 5 mm.

The number of turbine shroud sectors in the turbine shroud may be greater than or equal to 20, preferably greater than or equal to 30, still more preferably greater than or equal to 40.

BRIEF DESCRIPTION OF THE DRAWINGS

Other characteristics and advantages of the invention appear from the following description of implementations of the invention, given as nonlimiting examples, and with reference to the accompanying figures, in which.

DETAILED DESCRIPTION OF THE INVENTION

Figure 1:
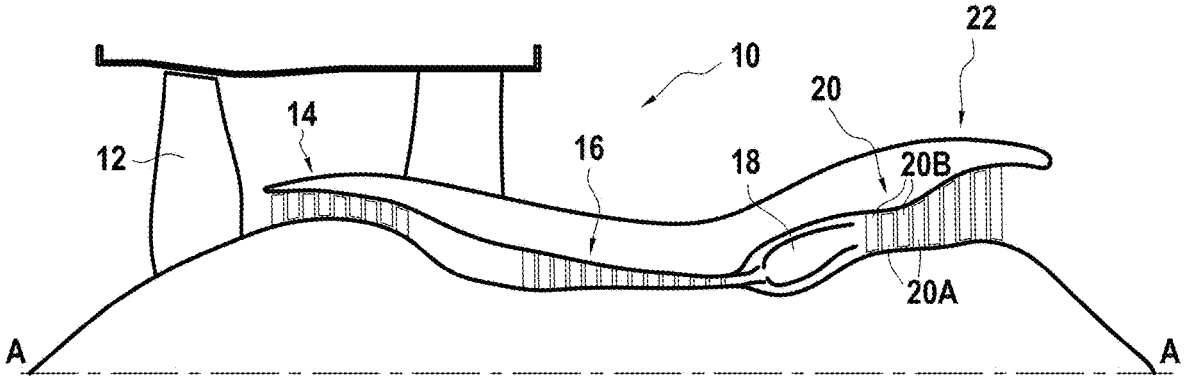
FIG. 1 is a diagrammatic longitudinal section view of a turbomachine.

FIG. 1 shows a bypass jet engine 10 seen in section on a vertical plane containing its main axis A. From upstream to downstream in the flow direction of the air stream, the bypass jet engine 10 comprises a fan 12, a low-pressure compressor 14, a high-pressure compressor 16, a combustion chamber 18, a high-pressure turbine 20, and a low-pressure turbine 22.

The high-pressure turbine 20 has a plurality of blades 20A that rotate with the rotor, and vanes 20B that are mounted on the stator. The stator of the turbine 20 has a plurality of stator shrouds 24 arranged facing the blades 20A of the turbine 20.

Figure 2:
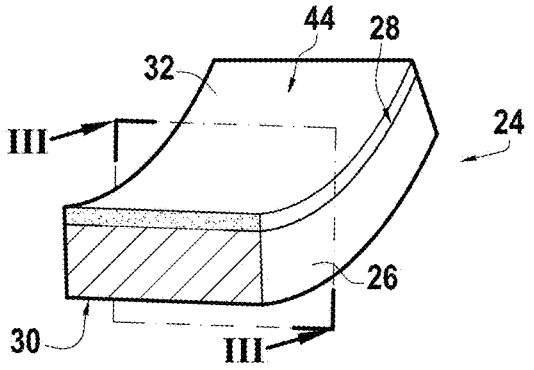
FIG. 2 is a diagrammatic perspective view of a turbine shroud sector including an abradable layer.

As can be seen in FIG. 2, each stator shroud 24 is made up of a plurality of shroud sectors 26. Each shroud sector 26 has an inner surface 28, an outer surface 30, and an abradable layer 32 against which the blades 20A of the rotor come into rubbing contact.

By way of example, the shroud sector 26 is made of a cobalt- or nickel-based superalloy, such as the AM1 superalloy or the N5 superalloy, and the abradable layer 32 is obtained from a metal powder based on cobalt or on nickel.

The method for manufacturing the turbine shroud 24 includes a first step for manufacturing at least one turbine shroud sector 26, e.g. by using a casting method.

Figure 3:
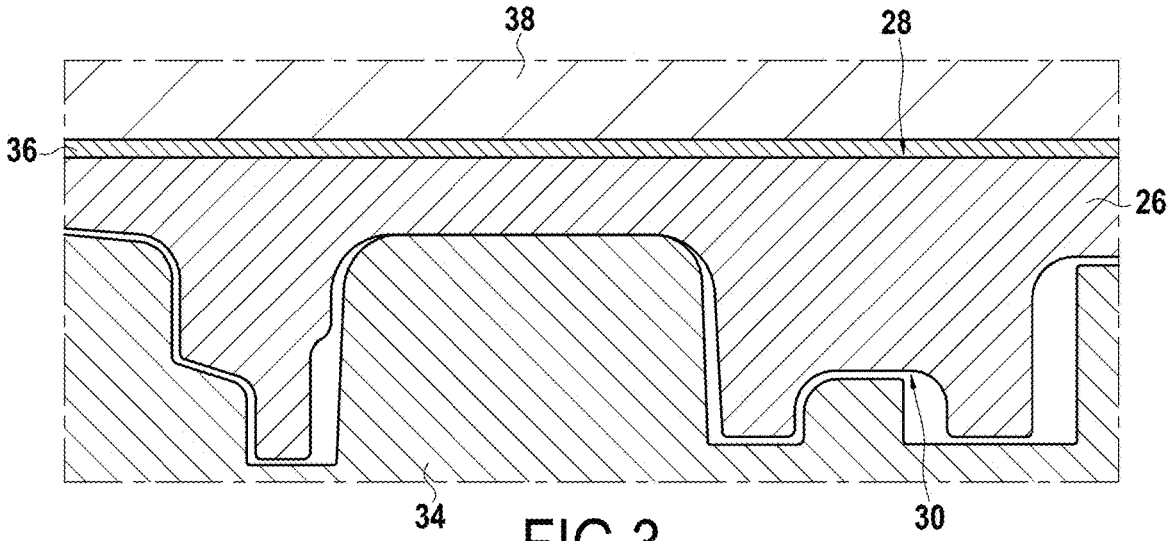
FIG. 3 is a section view of a turbine shroud sector in a mold for SPS sintering, the section plane being similar to the section plane III-III of FIG. 2.

FIG. 3 shows the turbine shroud sector 26 in section view in a mold for SPS sintering. The mold includes a bottom mold 34 of shape that is complementary to the outer surface 30 of the shroud sector 26.

The shroud sector 26 is positioned in a bottom mold 34 so that the outer surface 30 of the shroud sector 26 is in contact, at least in part, with the bottom mold 34. The bottom mold 34 is thus not in contact with the shroud sector 26 over the entire outer surface 30 of the shroud sector 26. The gaps visible between the shroud sector 26 and the bottom mold 34 serve to accommodate dimensional variations due to the method for manufacturing the various shroud sectors 26.

Nevertheless, since the shape of the bottom mold 34 is complementary to the outer surface 30 of the shroud sector 26, the pressure exerted by the bottom mold 34 on the shroud sector 26 is relatively uniform.

Thereafter, a powder layer 36 is deposited on the inner surface 28 of the shroud sector 26 and the top mold 38 is positioned on the powder layer 36.

Thereafter, the SPS sintering step is performed, which serves to obtain an abradable layer 32 made directly on the shroud sector 26. By way of example, the top mold 38 and the bottom mold 34 may be made of graphite. They may equally well be made of tungsten carbide.

Before placing the shroud sector 26 in the bottom mold 34, it is possible to deposit a layer of chemically inert material in the bottom mold 34 and on the top mold 38. By way of example, the chemically inert material may be boron nitride applied using a spray. It is also possible to add boron nitride powder so as to fill in the gaps present between the shroud sector 26 and the bottom mold 34.

The chemically inert material may also be corundum.

Thereafter, the shroud sector 26 coated in the abradable layer 32 is removed from the mold.

Figure 4A:
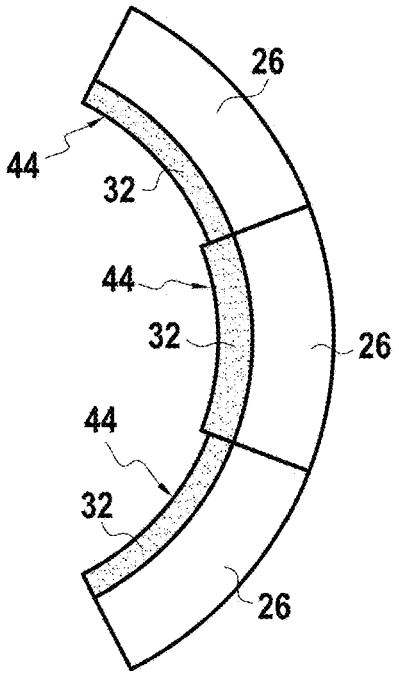
FIGS. 4A and 4B are diagrammatic side views of a plurality of turbine shroud sectors covered in an abradable layer, respectively before and after machining a free surface of the abradable layer.
Figure 4B:
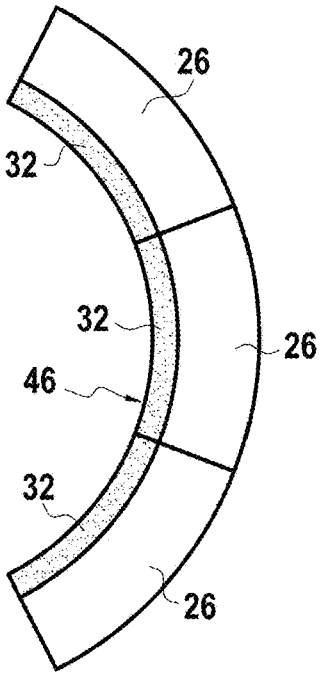

As shown in FIG. 4A, in order to make up a complete shroud 24, a plurality of shroud sectors 26 are assembled together, each shroud sector 26 being covered in an abradable layer 32. Once these turbine shroud sectors 26 have been assembled together, the abradable layer 32 of each shroud sector presents a free surface 44 that need not necessarily extend continuously from the free surface 44 of the adjacent shroud sector 26. Thus, the free surfaces 44 of the various shroud sectors 26 are machined so as to present a machined surface 46 that is to face the turbine wheel. The machined surface 46 presents as little discontinuity as possible.

Specifically, if any such discontinuity is present, then the turbine wheel could strike against such a discontinuity, thereby leading to impacts within the turbine, which is not desirable.

Figure 5:
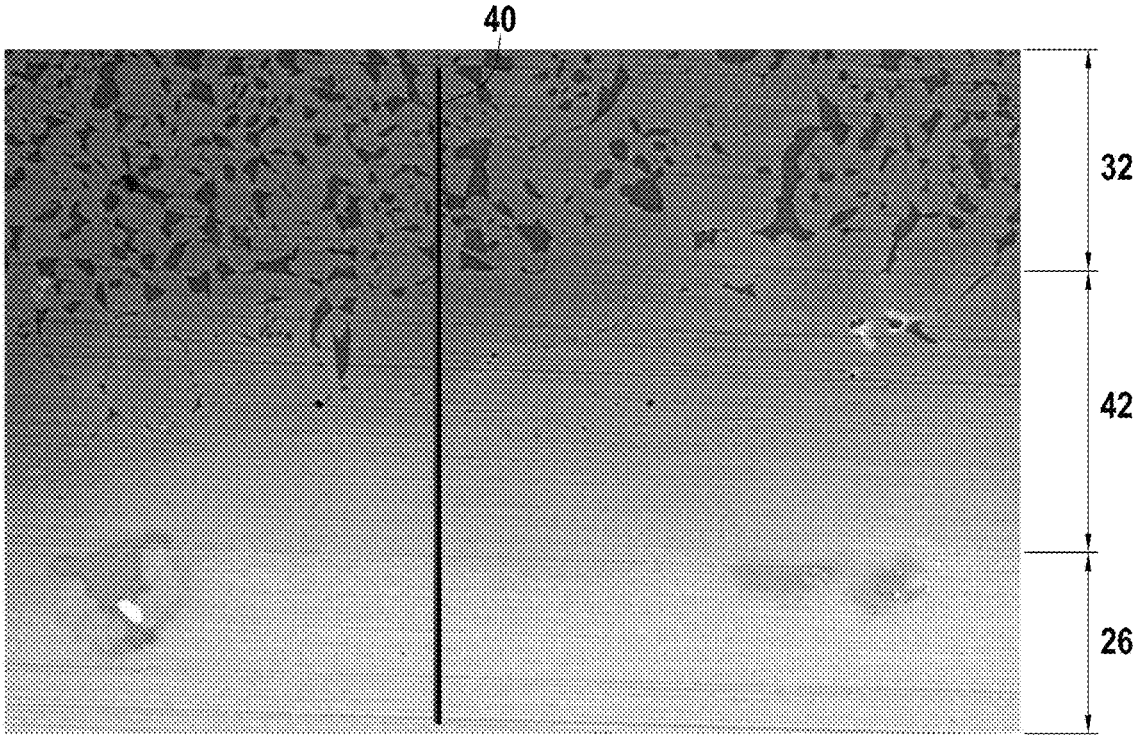
FIG. 5 is a scanning electron microscope image of an interface between a shroud sector and an abradable layer.

FIG. 5 is an image made with a scanning electron microscope of an interface between a shroud sector 26 and an abradable layer 32. By way of example, this abradable layer 32 is sintered on the shroud sector 26 at 950° C., under a pressure of 40 MPa, for 30 minutes.

Pressure may be applied when cold, i.e. from the beginning of the cycle, or when hot, during the period of sintering.

Figure 6:
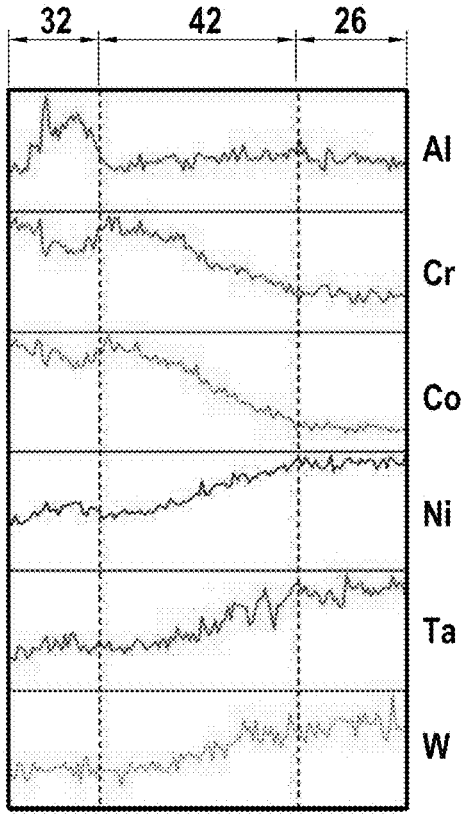
FIG. 6 shows how the concentration of certain chemical elements varies in the abradable layer of the shroud sector.

As can be seen in FIGS. 5 and 6, chemical composition varies progressively along line 40 of FIG. 5, starting from the shroud sector 26 and going towards the abradable layer 32, with a diffusion zone 42 being defined at the interface between the shroud sector 26 and the abradable layer 32.

FIGS. 7A-7D show various microstructures of abradable layers 32 presenting respective apparent porosities of about 10%, about 7%, about 3%, and practically zero.

Figure 7A:
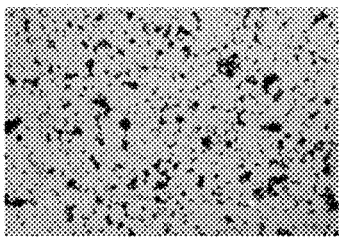
FIGS. 7A-7D are scanning electron microscope images showing the microstructure of the various abradable layers.
Figure 7B:
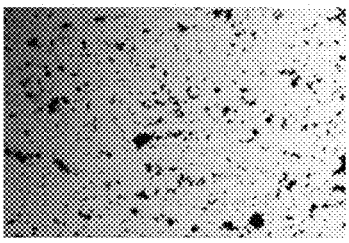
Figure 7C:
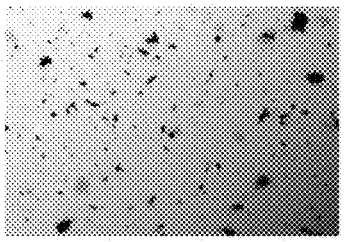
Figure 7D:
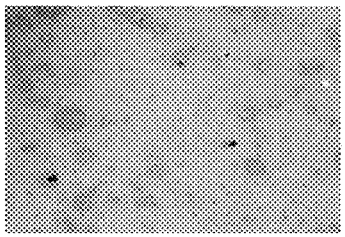

It can thus be seen that by modifying the SPS sintering parameters, such as temperature, pressure, and sintering time, it is possible to obtain abradable layers 32 presenting structures that are different. By way of example, FIG. 7A shows an abradable layer 32 obtained during an SPS sintering step at 925° C. for 10 minutes while applying a pressure of 20 MPa. FIG. 7D shows an abradable layer 32 obtained during an SPS sintering step at 950° C. for 30 minutes while applying a pressure of 40 MPa.

It can be understood that the thickness of the abradable layer 32 obtained after SPS sintering depends in particular on the thickness of the powder layer 36 deposited on the inner surface 28 of the shroud sector 26 and on the SPS sintering parameters. The thickness of the abradable layer 32 obtained after SPS sintering may also depend on the grain size and on the morphology of the powder used. In particular, the morphology of the powder may depend on the method for manufacturing the powder. Thus, a powder manufactured by gaseous atomization or by a rotating electrode has grains of substantially spherical shape, while a powder manufactured by liquid atomization has grains of shape that is less regular.

Although the present disclosure is described with reference to a specific implementation, it is clear that various modifications and changes may be undertaken on those implementations without going beyond the general ambit of the invention as defined by the claims. Also, individual characteristics of the various implementations mentioned above may be combined in additional implementations. Consequently, the description and the drawings should be considered in a sense that is illustrative rather than restrictive.

The invention claimed is:

1. A method for manufacturing a turbine shroud for a turbomachine, the method comprising the following steps:

manufacturing at least one turbine shroud sector;

positioning the turbine shroud sector in a bottom mold so that an outer surface of the turbine shroud sector is in contact at least in part with the bottom mold;

depositing a powder layer on an inner surface of the turbine shroud sector;

positioning a top mold on the powder layer; and making an abradable layer on the inner surface by subjecting the powder layer to a method of SPS sintering, the abradable layer being for being disposed facing a turbine wheel;

wherein before positioning the turbine shroud sector in the bottom mold and the top mold, a layer of chemically inert material is deposited on the bottom mold and on the top mold.

2. The method according to claim 1, further comprising the following steps:

assembling together a plurality of turbine shroud sectors, the inner surface of each turbine shroud sector being covered in an abradable layer; and machining a free surface of the abradable layer.

3. The method according to claim 1, wherein the bottom mold is of shape complementary to the outer surface of the turbine shroud sector.

4. The method according to claim 1, wherein the powder is a metal powder based on cobalt or on nickel.

5. The method according to claim 1, wherein the SPS sintering is performed for a duration shorter than or equal to 60 minutes.

6. The method according to claim 1, wherein the top mold and the bottom mold are made of graphite, and wherein the SPS sintering is performed at a temperature higher than or equal to 800° C.

7. The method according to claim 6, wherein the SPS sintering is performed at a pressure higher than or equal to 10 MPa.

8. The method according to claim 1, wherein the top mold and the bottom mold are made of tungsten carbide, and wherein the SPS sintering is performed at a temperature higher than or equal to 500° C.

9. The method according to claim 8, wherein the SPS sintering is performed at a pressure higher than or equal to 100 MPa.

* * * * *